US007537873B2

(12) United States Patent
Graham et al.

(10) Patent No.: US 7,537,873 B2
(45) Date of Patent: May 26, 2009

(54) POSITIVE-CHARGE INJECTION PREVENTING LAYER FOR ELECTROPHOTOGRAPHIC PHOTORECEPTORS

(75) Inventors: John Graham, Oakville (CA); Zoran D. Popovic, Mississauga (CA); Johann Junginger, Toronto (CA)

(73) Assignee: Xerox Corporation, Norwalk, CT (US)

( * ) Notice: Subject to any disclaimer, the term of this patent is extended or adjusted under 35 U.S.C. 154(b) by 358 days.

(21) Appl. No.: 11/556,923

(22) Filed: Nov. 6, 2006

(65) Prior Publication Data

US 2008/0107981 A1 May 8, 2008

(51) Int. Cl.
*G03G 15/04* (2006.01)

(52) U.S. Cl. ..... 430/66; 430/133

(58) Field of Classification Search ..... 430/66, 430/133

See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,281,054 | A | 7/1981 | Horgan et al. | |
| 4,298,697 | A | 11/1981 | Baczek et al. | |
| 4,338,390 | A | 7/1982 | Lu | |
| 4,457,994 | A | 7/1984 | Pai et al. | |
| 4,560,635 | A | 12/1985 | Hoffend et al. | |
| 4,871,634 | A | 10/1989 | Limburg et al. | |
| 5,368,967 | A | 11/1994 | Schank et al. | |
| 5,391,447 | A | 2/1995 | Pai et al. | |
| 5,681,679 | A | 10/1997 | Schank et al. | |
| 5,702,854 | A | 12/1997 | Schank et al. | |
| 5,709,974 | A | 1/1998 | Yuh et al. | |
| 5,976,744 | A | 11/1999 | Fuller et al. | |
| 2005/0181290 | A1 * | 8/2005 | Fuller et al. | 430/59.1 |
| 2005/0277036 | A1 * | 12/2005 | Dinh et al. | 430/66 |

OTHER PUBLICATIONS

U.S. Appl. No. 11/275,134, filed Dec. 13, 2005, to John F. Yanus et al.
U.S. Appl. No. 11/234,275, filed Sep. 26, 2005, to Kenny-tuan T. Dinh et al.

* cited by examiner

*Primary Examiner*—Mark A Chapman
(74) *Attorney, Agent, or Firm*—Oliff & Berridge, PLC

(57) ABSTRACT

Positive-charge injection-related ghosting of images in electrophotographic processes is addressed by electrophotographic photoreceptors that include a positive-charge injection preventing layer that includes one or more positive-charge-injection preventing compounds. In addition, processes are provided for preventing positive charge injection, in which the processes include a step of applying a positive-charge injection preventing composition to an electrophotographic photoreceptor in which the positive-charge injection preventing composition includes one or more positive-charge-injection preventing compound.

13 Claims, 4 Drawing Sheets

POSITIVE-CHARGE INJECTION PREVENTING LAYER FOR ELECTROPHOTOGRAPHIC PHOTORECEPTORS

TECHNICAL FIELD

This disclosure relates to electrophotographic imaging members and, more specifically, to layered photoreceptor structures with a positive-charge injection preventing layer. In particular, this disclosure relates to a positive-charge injection preventing layer comprising a positive-charge-injection preventing compound. This disclosure also relates to processes for making and using the imaging members.

RELATED APPLICATIONS

Commonly assigned, U.S. patent application Ser. No. 11/234,275 filed Sep. 26, 2005, to Kenny-tuan T. Dinh et al., describes an electrophotographic imaging member comprising: a substrate, a charge generating layer, a charge transport layer, and an overcoating layer, said overcoating layer comprising a cured polyester polyol or cured acrylated polyol film forming resin and a charge transport material.

Commonly assigned U.S. patent application Ser. No. 11/275,134 filed Dec. 13, 2005, to John F. Yanus et al., describes an electrophotographic imaging member comprising: a substrate, a charge generating layer, a charge transport layer, and an overcoating layer, said overcoating layer comprising a terphenyl arylamine dissolved or molecularly dispersed in a polymer binder.

Appropriate components and process aspects of each of the foregoing may be selected for the present disclosure in embodiments thereof. The entire disclosures of the above-mentioned applications are totally incorporated herein by reference.

REFERENCES

Overcoating layers for use with electrophotographic photoreceptors have been described, for example, in U.S. Pat. Nos. 4,050,935; 4,281,054; 4,457,994; 4,871,634; 5,368,967; 5,391,447; 5,681,679; 5,702,854; 5,709,974; and 5,976,744.

U.S. Pat. No. 4,050,935 describes an imaging member comprising a layer of trigonal selenium and a contigous layer of electrically active material consisting essentially of an electrically inactive polycarbonate resin having dispersed therein from about 15 to about 75 percent by weight of bis(4-diethylamino-2-methylphenyl)phenylmethane said trigonal selenium exhibiting the capability of photogeneration of holes and injection of said holes and said electrically active material being substantially non-absorbing in the spectral region at which the trigonal selenium generates and photogenerated holes but being capable of supporting the injection of photo-generated holes from said trigonal selenium and transporting said holes through said electrically active material.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,457,994 discloses a layered photosensitive member comprising a generator layer and a transport layer containing a diamine type molecule dispersed in a polymeric binder and an overcoat containing triphenyl methane molecules dispersed in a polymeric binder.

U.S. Pat. No. 4,871,634 discloses an electrostatographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 5,368,967 discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

U.S. Pat. No. 5,391,447 describes an electrophotographic imaging member comprising a substrate, a charge generating layer, a charge transport layer comprising electrically active charge transporting molecules dissolved or molecularly dispersed in a first electrically inactive polymer binder, and a charge transporting overcoat layer having a thickness between about 0.5 micrometer and about 10 micrometers, said overcoat comprising a triphenyl methane molecularly dispersed in an electrically inactive second polymer binder, said second polymer binder being soluble in a solvent in which said first polymer binder is insoluble and said charge transport layer being substantially free of any triphenylmethane molecules.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,709,974 discloses an electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,976,744 discloses an electrophotographic imaging member is disclosed including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

The disclosures of each of the foregoing patents and publications, and the disclosures of any patents and publications cited below, are hereby totally incorporated by reference. The appropriate components and process aspects of the each of the cited patents and publications may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light or a laser emission. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The photoconductive layer is an insulator in the dark so that electric charges are retained on its surface. Upon exposure to light, the charge is dissipated. The imaging process may be repeated many times with reusable imaging members.

As more advanced, higher speed electrophotographic copiers, duplicators and printers have been developed, and as the use of such devices increases in both the home and business environments, degradation of image quality has been encountered during extended cycling. Although excellent toner images may be obtained with multilayered belt or drum photoreceptors, it has been found that as more advanced, higher speed electrophotographic copiers, duplicators and printers are developed, there is a greater demand on copy quality. A delicate balance in charge, discharge, and bias potentials, and characteristics of the toner and/or developer, must be maintained.

One type of printing defect is referred to as "ghosting," which includes "transfer ghosting," "image ghosting," as well as other types of ghosting. While not wishing to be bound to any theory, one cause of this defect is believed to be photoreceptor damage caused by positive-charge injection. Positive charge injection is the injection of a positive charge from the surface of the photoreceptor to the bulk of the photoreceptor, which is believed to cause a shadow or ghost of an image to be transferred along with subsequent images.

Thus, there is a need for electrophotographic photoreceptors and electrophotographic techniques for preventing positive charge injection and related damage to photoreceptors, and to reduce or eliminate ghosting.

SUMMARY

The present disclosure addresses these and other needs, by providing electrophotographic photoreceptors and methods that reduce ghosting caused by positive charge injection from the photoreceptor surface to the photoreceptor bulk.

Exemplary electrophotographic photoreceptors include a positive-charge injection preventing overcoat layer comprising one or more positive-charge-injection preventing compound.

Exemplary processes include processes for preventing positive charge injection, that comprise: applying a positive-charge injection preventing overcoat composition to an electrophotographic photoreceptor; wherein the positive-charge injection preventing overcoat composition comprises one or more positive-charge-injection preventing compound.

These and other features and advantages of various embodiments of materials, devices, systems and/or methods are described in or are apparent from, the following detailed description.

BRIEF DESCRIPTION OF THE DRAWINGS

These and other advantages and features of this disclosure will be apparent from the following, especially when considered with the accompanying drawings, in which.

DETAILED DESCRIPTION OF EMBODIMENTS

Figure 1:
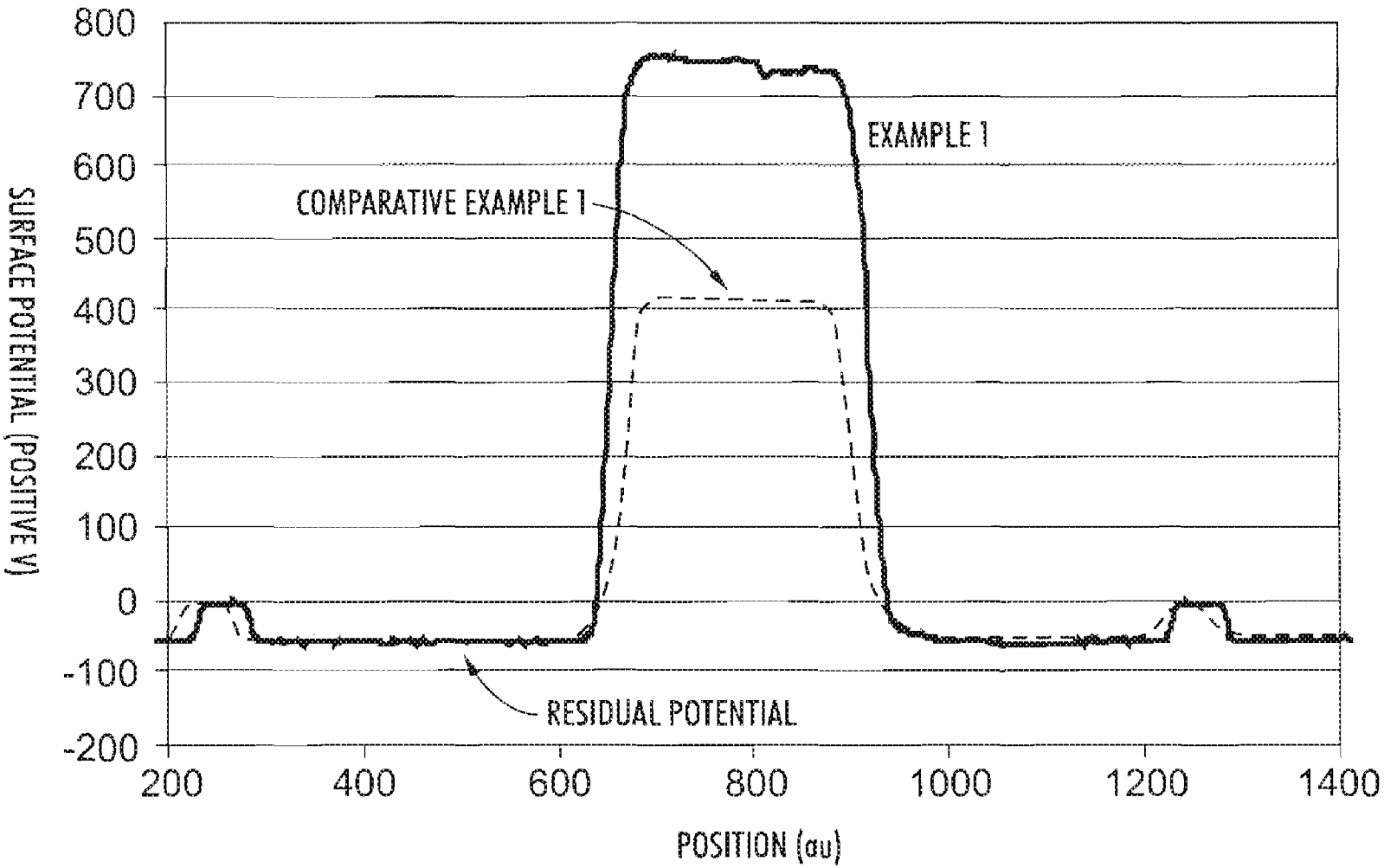
FIGS. 1-4 are graphs showing surface potentials tests for an exemplary imaging member and a comparative imaging member.

This disclosure is not limited to particular embodiments described herein, and some components and processes may be varied by one of skill, based on this disclosure. The terminology used herein is for the purpose of describing particular embodiments only, and is not intended to be limiting.

In this specification and the claims that follow, singular forms such as "a," "an," and "the" include plural forms unless the content clearly dictates otherwise. In addition, reference may be made to a number of terms that shall be defined as follows:

The term "organic molecule" refers, for example, to any molecule that is made up predominantly of carbon and hydrogen, such as, for example, alkanes and arylamines. The term "heteroatom" refers, for example, to any atom other than carbon and hydrogen. Typical heteroatoms included in organic molecules include oxygen, nitrogen, sulfur and the like.

The terms "standard temperature" and "standard pressure" refer, for example, to the standard conditions used as a basis where properties vary with temperature and/or pressure. Standard temperature is 0° C.; standard pressure is 101,325 Pa or 760.0 mmHg. The term "room temperature" refers, for example, to temperatures in a range of from about 20° C. to about 25° C.

The terms "high temperature environment" and "high temperature conditions" refer, for example, to an atmosphere in which the temperature is at least about 28 or about 30° C., and may be as high as about 100° C. The terms "high humidity environment" and "high humidity conditions" refer, for example, to an atmosphere in which the relative humidity is at least about 75 or about 80%.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

Electrophotographic imaging members are well known in the art. Electrophotographic imaging members may be prepared by any suitable technique. Typically, a flexible or rigid substrate is provided with an electrically conductive surface. A charge-generating layer is then applied to the electrically conductive surface. A charge-blocking layer may optionally be applied to the electrically conductive surface prior to the application of a charge generating layer. If desired, an adhesive layer may be utilized between the charge-blocking layer and the charge-generating layer. Usually the charge-generating layer is applied onto the charge-blocking layer and a charge-transport layer is formed on the charge-generating layer. This structure may have the charge-generating layer on top of or below the charge-transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole-blocking layer may be applied to the substrate. Any suitable and conventional hole-blocking layer that is capable of forming an electronic barrier to holes between the adjacent photoconductive layer and the underlying conductive surface of a substrate may be utilized.

An optional adhesive layer may be applied to the hole-blocking layer. Any suitable adhesive layer well known in the art may be utilized. Typical adhesive layer materials include, for example, polyesters, polyurethanes, and the like. Satisfactory results may be achieved with adhesive-layer thickness between about 0.05 micrometer (500 angstroms) and about 0.3 micrometer (3,000 angstroms). Conventional techniques for applying an adhesive-layer coating mixture to the charge-blocking layer include spraying, dip coating, roll coating, wire-wound-rod coating, gravure coating, Bird applicator coating, and the like. Drying of the deposited coating may be effected by any suitable conventional technique such as oven drying, infrared-radiation drying, air drying and the like.

At least one electrophotographic imaging layer is formed on the adhesive layer, hole-blocking layer or substrate. The electrophotographic imaging layer may be a single layer that performs both charge-generating and charge-transport functions as is well known in the art or it may comprise multiple layers such as a charge-generating layer and a separate charge-transport layer. Charge-generating layers may comprise amorphous films of selenium and alloys of selenium and arsenic, tellurium, germanium and the like, hydrogenated amorphous silicon and compounds of silicon and germanium, carbon, oxygen, nitrogen and the like; and may be fabricated by vacuum evaporation or deposition. The charge-generating layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film-forming polymeric binder and fabricated by solvent-coating techniques.

Phthalocyanines have been employed as photogenerating materials for use in laser printers utilizing infrared-exposure systems. Infrared sensitivity is required for photoreceptors exposed to low-cost semiconductor laser-diode light-exposure devices. The absorption spectrum and photosensitivity of the phthalocyanines depend on the central metal atom of the compound. Many metal phthalocyanines have been reported and include oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film-forming binder material may be employed as the matrix in the charge-generating (photogenerating) binder layer. Typical polymeric film-forming materials include those described, for example, in U.S. Pat. No. 3,121,006. Thus, typical organic polymeric film-forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 55 to about 90% by volume of the photogenerating pigment is dispersed in about 10 to about 95% by volume of the resinous binder, such as from about 20 to about 30% by volume of the photogenerating pigment is dispersed in about 70 to about 80% by volume of the resinous binder composition. In one embodiment, about 8% by volume of the photogenerating pigment is dispersed in about 92% by volume of the resinous binder composition. The photogenerator layers can also fabricated by vacuum sublimation in which case there is no binder.

Any suitable and conventional technique may be utilized to mix and thereafter apply the photogenerating-layer coating mixture. Typical application techniques include spraying, dip coating, roll coating, wire-wound-rod coating, vacuum sublimation and the like. For some applications, the photogenerating layer may be fabricated in a dot or line pattern. Removing of the solvent of a solvent coated layer may be effected by any suitable conventional technique such as oven drying, infrared-radiation drying, air drying and the like.

The charge-transport layer may comprise a charge-transporting small molecule dissolved or molecularly dispersed in a film-forming, electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge-transporting small molecule dispersed in the polymer, the small molecules being dispersed in the polymer on a molecular scale. Any suitable charge-transporting or electrically active small molecule may be employed in the charge-transport layer. The expression charge-transporting "small molecule" herein refers to as a monomer that allows the free charge that is photogenerated in the charge-transport layer to be transported across the charge-transport layer. Typical charge-transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde- 1,2-diphenyl hydrazone, and oxadiazoles such as 2,5-bis(4-N,N'-diethylaminophenyl)-1,2,4-oxadiazole, stilbenes and the like. As indicated above, suitable electrically active small-molecule charge-transporting compounds are dissolved or molecularly dispersed in electrically inactive polymeric film-forming materials. A small-molecule charge-transporting compound that permits injection of holes from the pigment into the charge-generating layer with high efficiency and transports them across the charge-transport layer with very short transit times is N,N'-diphenyl-N,N'-bis(3-methylphenyl)-(1,1'-biphenyl)-4,4'-diamine. If desired, the charge-transport material in the charge transport layer may comprise a polymeric charge-transport material or a combination of a small-molecule charge-transport material and a polymeric charge-transport material.

Any suitable electrically inactive resin binder insoluble in the alcohol solvent used to apply the overcoat layer may be employed in the charge-transport layer. Typical inactive resin binders include polycarbonate resin, polyester, polyarylate, polyacrylate, polyether, polysulfone, and the like. Molecular weights can vary, for example, from about 20,000 to about 150,000. In embodiments, the binders may include polycarbonates such as poly(4,4'-isopropylidene-diphenylene)carbonate (also referred to as bisphenol-A-polycarbonate, poly (4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge-transporting polymer may also be utilized in the charge-transport layer. The charge-transporting polymer should be insoluble in any solvent employed to apply the subsequent overcoat layer described below, such as an alcohol solvent. These electrically active charge-transporting polymeric materials should be capable of supporting the injection of photogenerated holes from the charge-generating material and be capable of allowing the transport of these holes therethrough.

Any suitable and conventional technique may be utilized to mix and thereafter apply the charge-transport layer coating mixture to the charge-generating layer. Typical application techniques include spraying, dip coating, roll coating, wire-wound-rod coating, and the like. Drying of the deposited coating may be effected by any suitable conventional technique such as oven drying, infrared-radiation drying, air drying and the like.

Generally, the thickness of the charge-transport layer is between about 10 and about 50 micrometers, but thicknesses outside this range can also be used. The hole-transport layer should be an insulator to the extent that the electrostatic charge placed on the hole-transport layer is not conducted in the absence of illumination at a rate sufficient to prevent formation and retention of an electrostatic latent image thereon. In general, the ratio of the thickness of the hole-transport layer to the charge-generating layers may be maintained from about 2:1 to about 200:1 and in some instances as great as about 400:1. The charge-transport layer, is substantially non-absorbing to visible light or radiation in the region of intended use but is electrically "active" in that it allows the injection of photogenerated holes from the photoconductive layer, i.e., charge-generating layer, and allows these holes to be transported through itself to selectively discharge a surface charge on the surface of the active layer.

To improve photoreceptor wear resistance, a protective overcoat layer can be provided over the charge transport layer. The protective overcoat layer generally includes at least a film-forming resin and a terphenyl hole-transporting molecule, such as a terphenyl diamine hole-transporting molecule. The protective overcoating layer can be formed, for example, from a solution or other suitable mixture of the film-forming resin and hole-transporting molecule.

The film-forming resin used in forming the protective overcoating layer can be any suitable film-forming resin, including any of those described above or us in the other layers of the imaging member. In embodiments, the film-forming resin can be electrically insulating, semi-conductive, or conductive, and can be hole transporting or not hole transporting. Thus, for example, suitable film-forming resins can be selected from, but are not limited to, thermoplastic and thermosetting resins such as polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrene and acrylonitrile copolymers, vinyl acetate copolymers, acrylate copolymers, alkyd resins, styrenebutadiene copolymers, styrene-alkyd resins, polyvinylcarbazole, and the like. In embodiments, the film-forming resin can be a polyester polyol or an acrylated polyol. These polymers may be block, random or alternating copolymers.

Any suitable alcohol solvent may be employed for the film-forming polymers. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely.

In embodiments, all of the components utilized in the protective overcoating solution of this disclosure should be soluble in the solvents or solvents employed for the overcoating. When at least one component in the protective overcoating mixture is not soluble in the solvent utilized, phase separation can occur, which would adversely affect the transparency of the protective overcoating and electrical performance of the final imaging member.

The thickness of the continuous protective overcoat layer selected depends upon the abrasiveness of the charging (e.g., bias-charging roll), cleaning (e.g., blade or web), development (e.g., brush), transfer (e.g., bias-transfer roll), etc., in the system employed and can range from about 1 or about 2 microns up to about 10 or about 15 microns or more. A thickness of between about 1 micrometer and about 5 micrometers in thickness is preferred, in some embodiments. Typical application techniques include spraying, dip coating, roll coating, wire-wound-rod coating, and the like. Drying of the deposited coating may be effected by any suitable conventional technique such as oven drying, infrared-radiation drying, air drying and the like. The dried overcoating of this disclosure should transport holes during imaging and should not have too high a free carrier concentration. Free carrier concentration in the overcoat increases the dark decay. In embodiments, the dark decay of the protective overcoat layer should be about the same as that of the unovercoated device.

In the dried protective overcoat layer, the composition can include from about 40 to about 90% by weight film-forming binder, and from about 60 to about 10% by weight terphenyl hole-transporting molecule. For example, in embodiments, the terphenyl hole-transporting molecule can be incorporated into the overcoating layer in an amount of from about 20 to about 50% by weight. As desired, the overcoating layer can also include other materials, such as conductive fillers, abrasion resistant fillers, and the like, in any suitable and known amounts.

In addition, photoreceptors of embodiments may include a positive-charge-injection preventing layer. In embodiments, such a layer includes at least one compound that prevents or slows positive-charge injection. The positive-charge injection preventing layer may be provided as a cleanable film, and in embodiments, may be provided in situ from either solid state composition or a liquid solution.

The positive-charge injection preventing layer of embodiments includes at least one composition capable of preventing or slowing positive-charge injection. The positive-charge injection preventing composition may include positive-charge injection preventing molecules, such as hole-blocking compounds, hole-trapping compounds, weak hole-transporting compounds as compared to the transporting compound in the charge transport layer, and mixtures thereof.

Suitable weak hole-transporting compounds for use in embodiments including compounds, such as bis(4-diethylamino-2-methylphenyl) phenylmethane.

In embodiments, the positive-charge injection preventing overcoat composition may be applied as a solution in a solvent. Solvents that may be used in embodiments include, for example, alcohol solvents, organic solvents, and mixtures thereof. Suitable alcohol solvents include, for example, butanol, propanol, isopropanol, methanol, and the like and mixtures thereof. Suitable organic solvents include, for example, methylene chloride, tetrahydrofuran, monochlorobenzene, and mixtures thereof.

In embodiments the positive-charge injection preventing layer may be provided onto the outermost surface of a photoreceptor in situ, as part of an image-formation process. For example, the positive-charge injection preventing composition may be provided by applying a liquid or solid-state solution containing the positive-charge injection preventing composition, by any known method.

In addition, the positive-charge injection preventing composition may be applied by contacting the photoreceptor with another material that contains the positive-charge injection preventing composition, and allowing the positive-charge injection preventing composition to be transferred to the photoreceptor. For example, a positive-charge injection preventing composition may be included in a toner, which contacts the photoreceptor during image formation. Alternatively, the positive-charge injection preventing composition may be included in a cleaning blade, and the positive-charge injection preventing composition may be allowed to leach from the cleaning blade onto the photoreceptor surface during a cleaning step of image formation. Alternatively, the positive-charge injection preventing layer may be provided by contacting a solid state solution containing the positive-charge injection preventing composition with the photoreceptor; in such embodiments, the positive-charge injection preventing composition may be provided as a lub bar that can be controlled to move into and out of contact with the photoreceptor to apply the positive-charge injection preventing composition.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

Specific examples are described in detail below. These examples are intended to be illustrative, and the materials, conditions, and process parameters set forth in these exemplary embodiments are not limiting. All parts and percentages are by weight unless otherwise indicated.

EXAMPLES

Example 1

Photoreceptor Including Positive-Charge Injection Preventing Layer

Layered photoconductive imaging members were prepared by the following procedure. A titanized MYLAR® substrate of 75 microns in thickness with a γ-aminopropyl triethoxy silane layer, 0.1 micron in thickness, thereover, and E.I. DuPont 49,000 polyester adhesive thereon in a thickness of 0.1 micron was used as the base conductive film. A hydroxygallium phthalocyanine charge-generating layer (CGL) was prepared as follows: 0.55 gram of HOGaPc (V) pigment was mixed with 0.58 gram of poly(styrene-b-4-vinylpyridine) polymer and 20 grams of toluene in a 60 milliliter glass bottle containing 70 grams of approximately 0.8 millimeter diameter glass beads. The bottle was placed in a paint shaker and shaken for 2 hours. The resultant pigment dispersion was coated using a #8 wire rod onto the polyester adhesive layer. Thereafter, the photogenerating layer formed was dried in a forced air over at 100° C. for 10 minutes.

A charge-transport layer solution was generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A.G.), and 133 grams of methylene chloride. The mixture was stirred overnight, about 18 to about 20 hours, until a complete solution was obtained. The transport solution was then coated onto the above photogenerating layer using a Bird film applicator with a 4 mil gap. The resulting member was dried at 100° C. in a forced air oven for 30 minutes. The final dried thickness of the charge-transport layer was about 28 microns.

A solution of triphenylmethane was prepared by adding methylene chloride to 100 mg of bis(4-diethylamino-2-methylphenyl) phenylmethane (TPM) until the triphenylmethane was dissolved. The triphenylmethane solution was diluted to about 10:1 in isopropanol. The surface of the photoreceptor (charge-transport layer surface) is coated by rubbing the surface with the triphenylmethane solution.

Comparative Example 1

For comparison, a reference imaging device is prepared in the same manner described above in Example 1, except that the photoreceptor surface was coated with a mixture of methylene chloride and isopropanol that did not include triphenylmethane, to ensure that any observed effects were due to the exemplary positive-charge injection preventing layer, the triphenylmethane coating of Example 1.

The photoreceptors of Example 1 and Comparative Example 1 were tested using a surrogate imaging system. The surrogate imaging system stimulates an electrophotographic print engine operating without toner or paper. A positive scorotron is pulsed to charge a small, registered area of the Device Under Test (DUT), thereby simulating the positive charging of the photoreceptor that may occur during the transfer step. Each cycle of the surrogate imaging system consists of two subcyles, which are identical except that in the first subcycle, the expose light is off, and in the second subcycle, the expose light is switched on to produce about half discharge.

The photoreceptors of Example 1 and Comparative Example 1 were individually tested by cycling the photoreceptors 500×2 cycles (1 kcycle total) with the pulsed scorotron off to establish a baseline, followed by 2500×2 (5 kcycle) pulsed cycles to simulate charging during the transfer step and finally another 500×2 post-exposure cycles to establish a post-stimulus baseline.

FIG. 1 shows the surface potentials of the photoreceptors of Example 1 and Comparative Example 1, during pulsed positive charging, in which the positive scorotron is pulsed on and off. In FIG. 1, zero potential points correspond to adhesive copper tape used to fix the flexible photoreceptor web to the drum. The photoreceptor of Comparative Example 1 had a positive-charging current of 1.61 mA, while the photoreceptor of Example 1 had a positive-charging current of 1.41 mA. However, the photoreceptor of Comparative Example 1 was charged to only about one-half of the potential to which the photoreceptor of Example 1 was charged. This demonstrates that photoreceptor or Example 1 had reduced or prevented positive-charge injection into the photoreceptor charge-transport layer, relative to the photoreceptor of Comparative Example 1.

Figure 2:
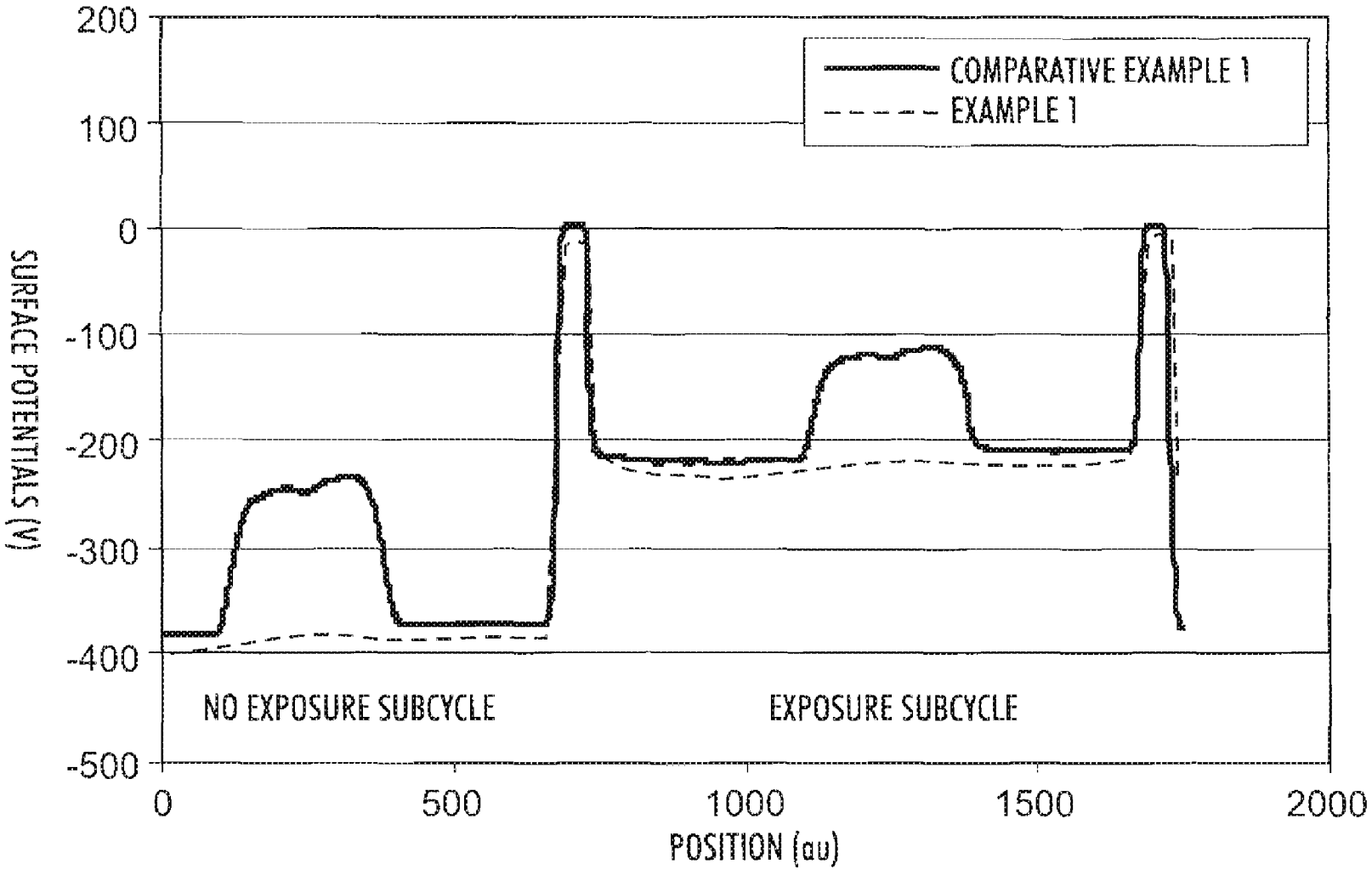

FIG. 2 shows the surface potential of the photoreceptors of Example 1 and Comparative Example 1, immediately after negative-charge cycling while positive pulse excitation is present. As can be seen from FIG. 2, the photoreceptor of Comparative Example 1 cannot be charged to a uniform potential, while the photoreceptor of Example 1 has much more uniform surface potential, both without and with exposure.

Dramatic differences between charging levels for the two samples in the presence of positive charging strongly indicates that significant ghost reduction can be expected with the use of the positive-charge injection preventing layer.

In addition, an imaging test was also conducted on the photoreceptor of Example 1 and the photoreceptor of Comparative Example 1, in which total ghosting and discharge ghosting were determined from the cycling data described above.

Specifically, the 500×2 pre-stimulus cycles, for the photoreceptor of Example 1 and the photoreceptor of Comparative Example 1, are averaged to provide a baseline; and the 500×2 post-stimulus cycles are similarly averaged. The pre-stimulus signal, subtracted from the post-stimulus signal, forms a difference signal. A difference signal is computed for the expose probe and for the post-negative-charging probe (charge probe). The pos-Q-stimulated region of the exposure subcycle, which simulates the transfer zone, of the charge probe difference signal (peak 1) is extracted and laterally shifted to align with the no-exposure pos-Q-stimulated region of the expose probe difference signal (peak 2). The non-pos-Q-exposed portion of the curves (baselines) are aligned and the difference in amplitude, if any, of the two peaks is the dark decay ghost.

The discharge ghost is computed from the expose probe difference signal alone–the peak in the exposure sub-cycle (peak 3) is extracted and shifted to align with the peak (peak 2) in the no-exposure-sub-cycle. The difference, peak 3–peak 2, after the baseline is zero-ed, is the discharge ghost.

The total ghost can be computed by summing the discharge ghost with the dark decay ghost. It can also be calculated directly from the difference signals using the extract and shift procedure described above by aligning and subtracting peak 1 from peak 3.

Figure 3:
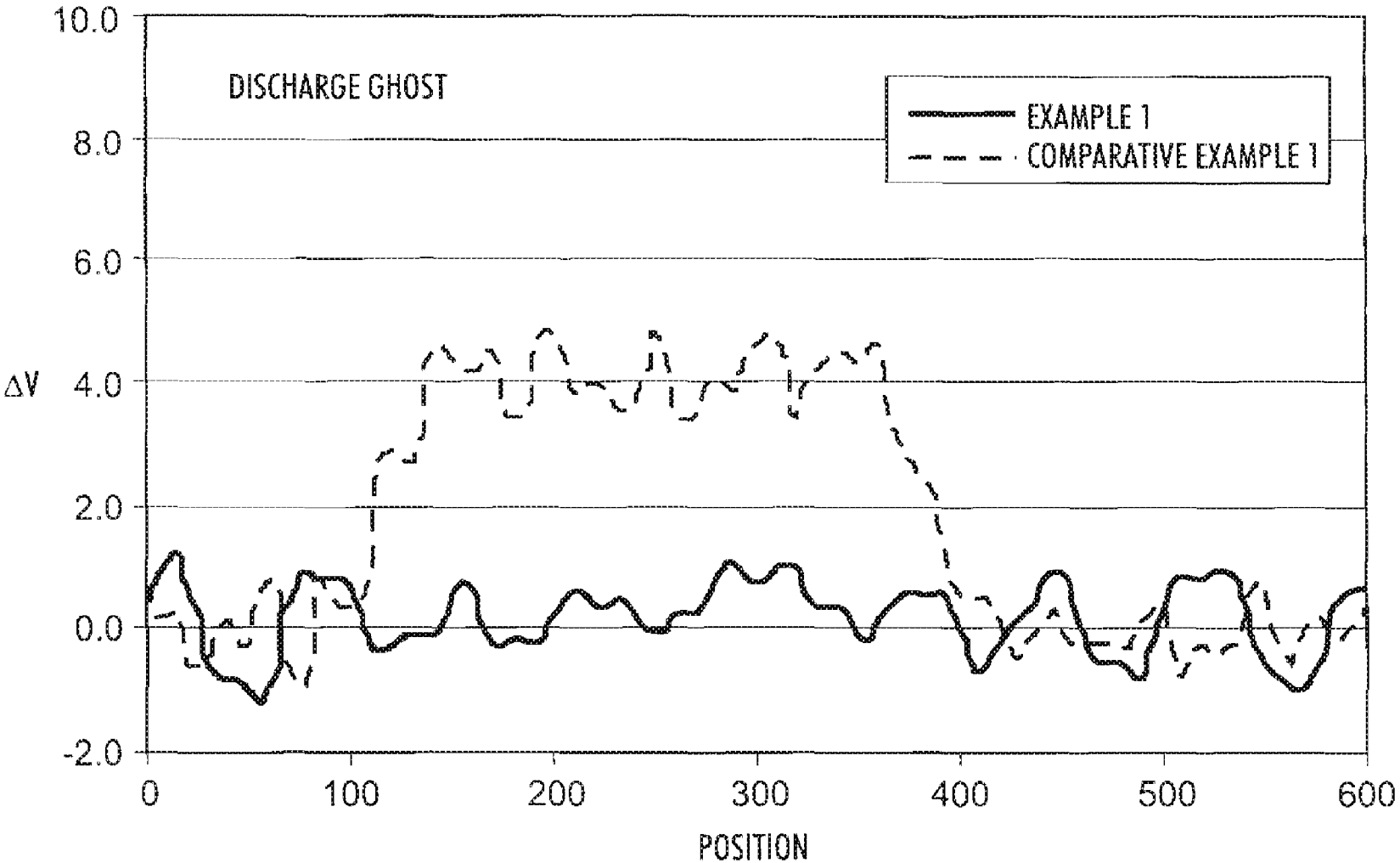
Figure 4:
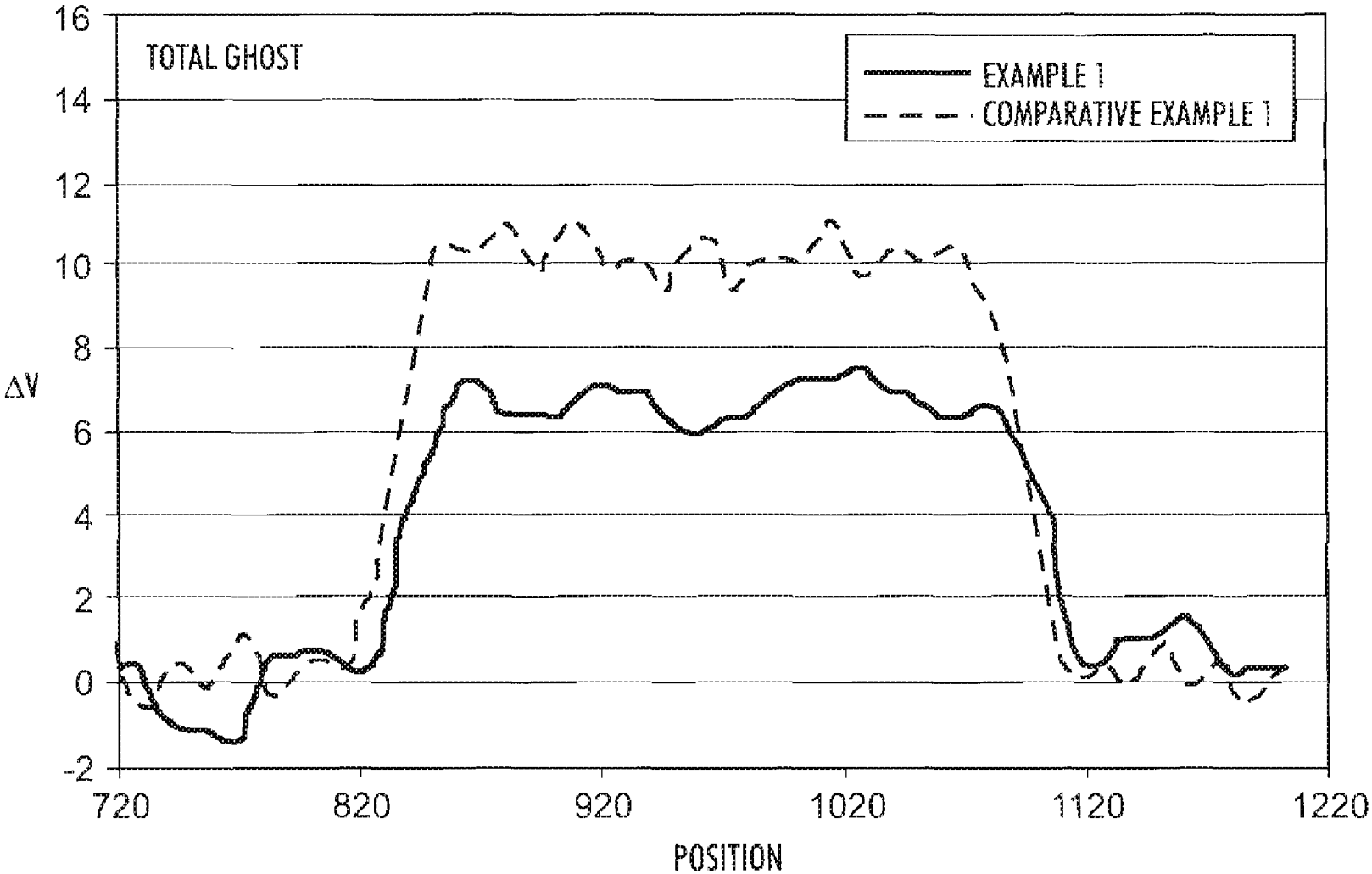

The results of these computations are shown in FIGS. 3 and 4. The positive-charge injection preventing layer of photoreceptor of Example 1 completely eliminates discharge ghost, as shown by the photoreceptor sensitivity change induced by positive corona, FIG. 3, and significantly reduces total ghost, as shown in FIG. 4, which also takes into account differences in dark decay of areas exposed and not exposed to positive corona.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic photoreceptor, comprising
a substrate;
a charge-generating layer
a charge-transport layer; and
a positive-charge injection preventing layer consisting essentially of at least one positive-charge-injection preventing compound and optionally one or more solvents.

2. The electrophotographic photoreceptor according to claim 1, wherein said positive-charge injection preventing layer is a cleanable film.

3. The electrophotographic photoreceptor according to claim 1, wherein the at least one positive-charge-injection preventing compound is one or more compounds chosen from the group consisting of hole-blocking compounds, hole-trapping compounds, weak hole-transport compounds, and mixtures thereof.

4. The electrophotographic photoreceptor according to claim 1, wherein the at least one positive-charge-injection preventing compound is triphenylmethane.

5. The electrophotographic photoreceptor according to claim 1, wherein the positive-charge injection preventing layer is applied during an electrophotographic process.

6. A process for preventing positive charge injection, comprising:
applying a positive-charge injection preventing composition to an electrophotographic photoreceptor;
wherein the positive-charge injection preventing composition consisting essentially of at least one positive-charge-injection preventing compound and optionally one or more solvents,
wherein said applying includes one or more steps chosen from the group consisting of:
applying a solution containing the at least one positive-charge-injection preventing compound to said photoreceptor; and
contacting a material containing the at least one positive-charge-injection preventing compound with a surface of said photoreceptor and transferring the at least one positive-charge-injection preventing compound to said photoreceptor surface.

7. The process according to claim 6, wherein the at least one positive-charge-injection preventing compound is one or more compounds chosen from the group consisting of hole-blocking compounds, hole-trapping compounds, weak hole-transport compounds, and mixtures thereof.

8. The process according to claim 6, wherein the at least one positive-charge-injection preventing compound is triphenylmethane.

9. The process according to claim 6, wherein said positive-charge injection preventing composition is a liquid solution containing the at least one positive-charge-injection preventing compound and one or more solvents.

10. The process according to claim 9, wherein the liquid solution comprises triphenylmethane dissolved in methylene chloride and isopropanol.

11. The process according to claim 6, wherein said positive-charge injection preventing composition is a solid-state solution containing the at least one positive-charge-injection preventing compound.

12. The process according to claim 6, wherein the contacting comprises contacting the surface of the electrophotographic photoreceptor with a cleaning blade or a toner composition, comprising the positive-charge injection preventing composition.

13. A process for forming an electrophotographic imaging member comprising:
providing an electrophotographic imaging member comprising
a substrate,
a charge-generating layer, and
a charge-transport layer, and forming thereover a positive-charge injection preventing layer;
wherein the positive-charge injection preventing layer consists essentially of at least one positive-charge-injection preventing compound and optionally one or more solvents, and
wherein said forming includes one or more steps chosen from the group consisting of:
applying a solution containing the at least one positive-charge-injection preventing compound to the electrophotographic imaging member; and
contacting a material containing the at least one positive-charge-injection preventing compound with a surface of the electrophotographic imaging member and transferring the at least one positive-charge-injection preventing compound to the surface of the electrophotographic imaging member.

* * * * *